US005207026A

United States Patent [19]

Bozeman, Jr.

[11] Patent Number: 5,207,026

[45] Date of Patent: May 4, 1993

[54] LOCKING THRESHOLD

[76] Inventor: William D. Bozeman, Jr., P.O. Box 310, Mansfield, Ga. 30255

[21] Appl. No.: 808,299

[22] Filed: Dec. 16, 1991

[51] Int. Cl.[5] ..... E06B 1/70

[52] U.S. Cl. ..... 49/467; 49/469; 292/DIG. 15

[58] Field of Search ..... 49/467, 468, 469, 470, 471, 49/394; 292/DIG. 15

[56] References Cited

U.S. PATENT DOCUMENTS

| | | | |
|---|---|---|---|
| 3,805,322 | 4/1974 | Serrano | 292/DIG. 15 X |
| 4,348,879 | 9/1982 | Knierim | 292/DIG. 15 X |
| 4,631,776 | 12/1986 | King | 292/DIG. 15 X |
| 4,797,970 | 1/1989 | Charlton | 292/DIG. 15 X |
| 5,029,911 | 7/1991 | Daniels | 49/467 X |

*Primary Examiner*—Philip C. Kannan
*Attorney, Agent, or Firm*—James B. Middleton

[57] ABSTRACT

A locking threshold has a hinged locking member receivable within a chamber within the threshold. The locking member is pulled from the threshold, and a locking flange is pivoted to a right angle from the threshold, and the floor. The locking member is then urged in, and moved sideways to lock the locking member with respect to the threshold. Screws extending through the threshold pass through the locking member, and slots in the locking member allow limited sliding movement of the locking member, and locking of the locking member.

3 Claims, 1 Drawing Sheet

LOCKING THRESHOLD

BACKGROUND OF THE INVENTION

1. Field of the Invention

This invention relates generally to thresholds, and is more particularly concerned with a threshold that will selectively prevent a door from opening.

2. Description of the Prior Art

It is common to utilize a threshold in a doorway, the primary purposes of the threshold being to cover the joint in flooring at the doorway, and to seal the space below the door. In pursuance of these ends, there are numerous arrangements for providing a replaceable weatherstrip along the threshold.

In recent years there have been increased efforts to provide locking means for doors. Though the cylinder locks are quite sophisticated, a deadbolt is of little value against the brute force that breaks the door itself, causing the entire deadbolt to fall from the door. The breaking of the doors is especially easy for French doors, wherein double doors are locked in the middle simply by pins or the like extending from the door into the framing. By exerting force against the doors, the pins can be broken from the doors, and the doors will open easily.

The prior art includes some means for engaging the lower portion of a door in an effort to secure the door. These prior art locking means have included some devices that extend from the floor to engage the door, and at least one threshold that has a locking member selectively extendible from the threshold to engage the door. The prior art locking means are very complex, and some of them are rather unsightly. Thus, the prior art has not provided a simple, yet effective door locking means in conjunction with a threshold.

SUMMARY OF THE INVENTION

The present invention provides a threshold having a door locking member selectively storable within the threshold and movable to a door locking position. The door locking member comprises a hinge having a first flange slidable with respect to the threshold, and selectively lockable in a door locking position, and a second flange selectively pivotal between a stored position and a door locking position.

In the preferred embodiment of the invention, the door locking means comprises generally a piano hinge having two flanges pivotal with respect to each other. The first flange defines openings with locking slots at one end thereof. The second flange is pivotal through approximately 90°, so the second flange can be pivoted to a position parallel with the first flange for storing, or to a position perpendicular to the first flange so the door will engage the second flange.

BRIEF DESCRIPTION OF THE DRAWING

These and other features and advantages of the present invention will become apparent from consideration of the following specification when taken in conjunction with the accompanying drawing in which.

DETAILED DESCRIPTION OF THE PREFERRED EMBODIMENT

Figure 1:
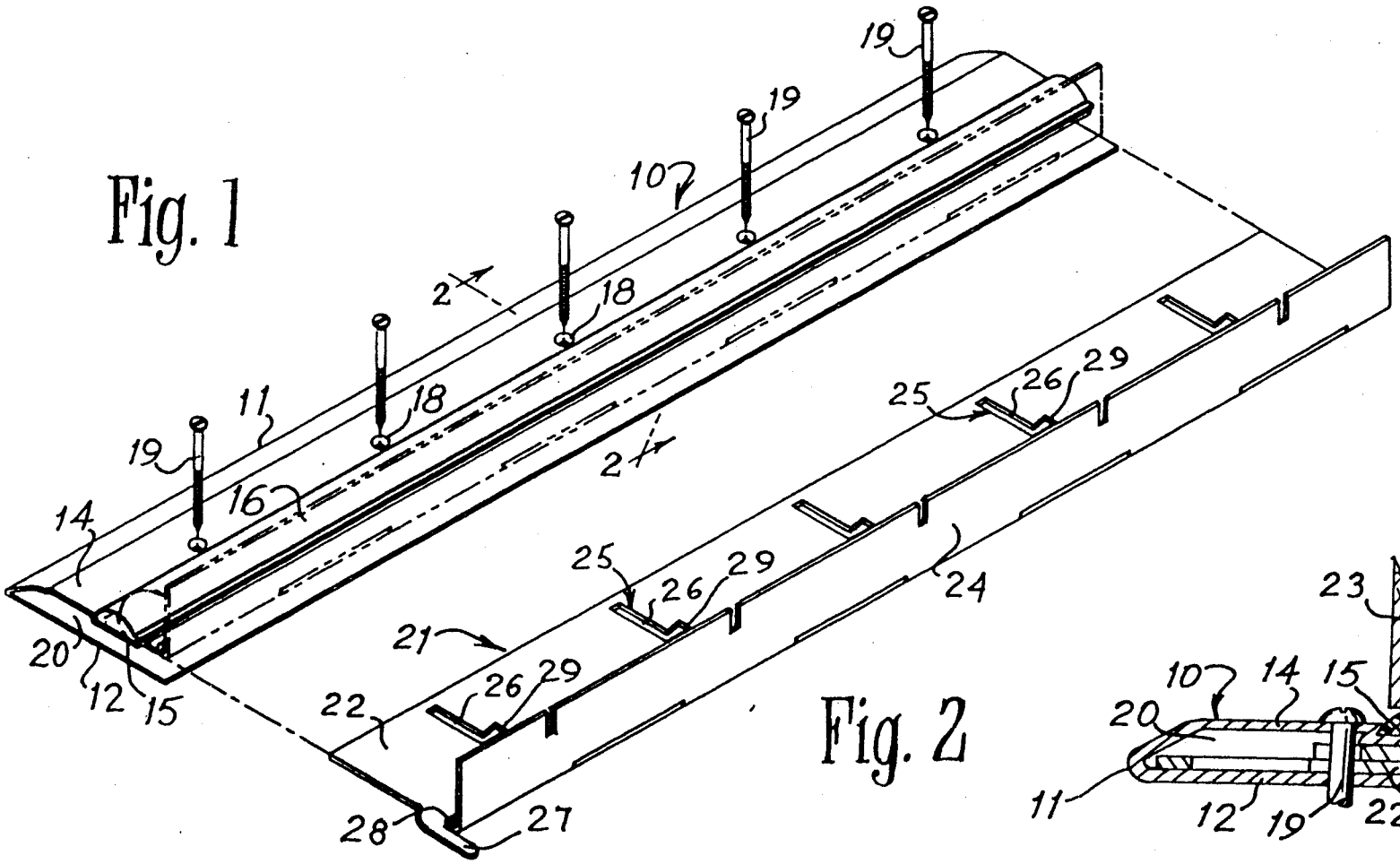
FIG. 1 is a perspective view showing a threshold piece made in accordance with the present invention, the door locking member being shown exploded from the threshold piece, and being shown in phantom engaged with the threshold piece and in door locking position; and, FIG. 2 is an enlarged cross-sectional view taken along the line 2—2 in FIG. 1.
Figure 2:
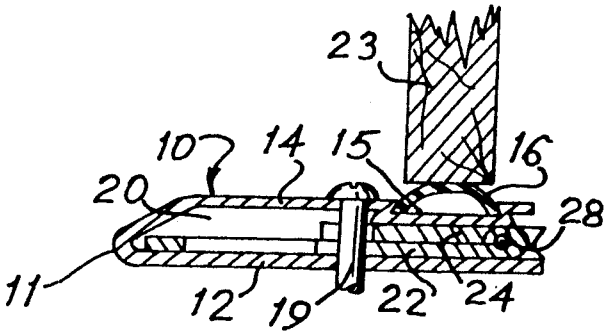

Referring now more particularly to the drawings, and to that embodiment of the invention here presented by way of illustration, the drawings show a threshold piece generally designated at 10 having an outside, beveled edge 11. As here shown, the threshold piece comprises a base member 12, and an upper member 14. The base member 12 and upper member 14 are connected together along one edge, which provides the beveled edge 11. The upper member 14 defines a longitudinal slot 15 which receives a piece of weatherstripping 16. The threshold 10 also defines a plurality of holes 18 for receiving screws 19.

Those skilled in the art will realize that the conventional threshold comprises a single member with interior supporting flanges, rather than the base and upper members as here shown. Also, the screws for holding the conventional threshold piece in place are usually rather small and short, just strong enough to hold the threshold in place. In the present invention, however, it is contemplated that the screws 19 will be of sufficiently large diameter and length to provide needed strength as will be discussed below.

In the case of pre-fabricated doors, the door and door frame are shipped to a building site with the door already hung in the door frame, which includes the threshold. The threshold is usually attached only to the pre-fabricated door unit. Thus, when the threshold of the present invention is used in a prefabricated door unit, the threshold will contain screws that pass through the threshold and into the sub-flooring.

With the above described construction, it will be understood that the threshold defines a chamber 20 between the base 12 and the upper member 14, the chamber 20 opening along the inside edge of the threshold 10. This chamber 20 receives the locking means generally designated at 21. As will be discussed fully below, the locking means 21 includes a first flange 22 that is slidable with respect to the threshold 10, but is limited in its movement, and a second flange 24 that is pivotal with respect to the first flange.

Those skilled in the art will understand that hinges with limited movement are well known. Most commonly such hinges include portions of the flanges that extend straight, without wrapping around the hinge pin, so the flanges abut and prevent further movement. Other mechanical arrangements may be used, and are contemplated by the present invention.

The first flange 22 of the locking means 21 defines a plurality of openings 25, the openings 25 including a slot 26 elongated in a direction across threshold piece 10, and perpendicular to the hinge pin 28. The opening 25 also includes a locking slot 29 which may be in the form of a bayonet slot or the like. As here shown, the locking slot 29 has only a slight angle, but it will be understood that a much deeper angle can be used if security requires.

It should now be understood that, when the locking member 21 is in place within the chamber 20 of the threshold 10, the openings 25 will be aligned with the holes 18 in the threshold 10. Screws 19 will then pass through the threshold 10, through the locking member 21, and into the sub-flooring beneath the threshold 10. Since the openings 25 include the slots 26, the locking member 21 will be slidable with respect to the threshold 10.

The chamber 20 is so dimensioned as to receive the locking member 21 with the flange 24 folded down parallel to the flange 22. In this position, the threshold 10 will hardly be distinguishable from a conventional threshold. The locking member 21 will preferably substantially fill the chamber 20 so no gap will be readily noticeable.

When the locking member 21 is to be utilized, the locking member 21 will be slid from the chamber 20, towards the inside edge of the threshold piece 10, until it is stopped by the screws 19 in the slots 26. At this point, the flange 24 can be pivoted up, to the position shown in the drawings. The locking member 21 is next slid back into the chamber 20 of the threshold 10 until the screws 19 reach the locking slots 29, whereupon the locking member 21 is moved sideways, or longitudinally of the threshold 10, in a direction parallel to the axis of the hinge pin 28. By then pulling the locking member 21 out somewhat, or attempting to open the door 23, the screws 19 will become seated within the locking slots 29. If desired, of course, springs or the like may be used to urge the locking member 21 out, and/or to maintain engagement of the screws 19 with the locking slots 29.

When the locking means is to be released, the locking member 21 will be pushed in to release the screws from the locking slots 29, the locking member 21 will be moved sideways to place the screws 19 in the slots 26, then slid from the chamber 20 and the flange 24 can once again be folded down and the member 21 stored in the chamber 20 of the threshold 10.

It will therefore be understood by those skilled in the art that the threshold of the present invention provides a very simple, yet very effective locking means for a door. When the flange 24 is up, in locking position, there is a metal member extending substantially the full width of the door 23. Simply pushing against the outside of the door 23 will more firmly seat the screws 19 in the locking slots 29; and, even if one portion of the flange 24 is bent, the balance of the flange will still hold the door closed. When not in use, the locking member stores neatly within the threshold, and is easy to retrieve when needed using the tabs 27.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A locking threshold, for a doorway having an outside and an inside, and a door hingedly mounted within said doorway and openable towards said inside, said threshold including an outside edge towards said outside of said doorway and an inside edge towards said inside of said doorway, said threshold defining a chamber therein, and a locking member slidably received within said chamber, said locking member including a first flange, means for limiting motion of said first flange, and a second flange selectively pivotal to a first position parallel to said first flange and a second position perpendicular to said first flange, said second flange having sufficient width to engage said door when said second flange is in said second position.

2. A locking threshold as claimed in claim 1, and further including a plurality of posts extending through said threshold and said chamber, said first flange of said locking member defining a plurality of openings therethrough, each opening of said plurality of openings receiving one post of said plurality of posts therethrough, each opening of said plurality of openings defining an elongated slot so that said first flange is slidable with respect to said threshold, and at least one locking slot communicating with said elongated slot for limiting motion of said first flange.

3. A locking threshold as claimed in claim 2, said plurality of posts comprising a plurality of screws passing through said threshold and fixing said threshold to said doorway.

* * * * *